US006182775B1

(12) United States Patent
Hipp

(10) Patent No.: US 6,182,775 B1
(45) Date of Patent: Feb. 6, 2001

(54) DOWNHOLE JAR APPARATUS FOR USE IN OIL AND GAS WELLS

(75) Inventor: James E. Hipp, New Iberia, LA (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/095,389

(22) Filed: Jun. 10, 1998

(51) Int. Cl.[7] ..... E21B 4/14
(52) U.S. Cl. ..... 175/296; 166/178
(58) Field of Search ..... 175/296, 297, 175/299; 166/178

(56) References Cited

U.S. PATENT DOCUMENTS

| | | | | |
|---|---|---|---|---|
| 3,735,827 | * | 5/1973 | Berryman | 166/178 |
| 3,851,717 | * | 12/1974 | Berryman | 175/297 |
| 3,946,819 | | 3/1976 | Hipp | 175/296 |
| 4,059,167 | * | 11/1977 | Berryman | 175/297 |
| 4,361,195 | * | 11/1982 | Evans | 175/297 |
| 4,462,471 | | 7/1984 | Hipp | 175/296 |
| 4,702,325 | | 10/1987 | Hipp | 173/64 |
| 4,958,691 | | 9/1990 | Hipp | 175/296 |
| 5,033,557 | * | 7/1991 | Askew | 175/297 |
| 5,156,223 | | 10/1992 | Hipp | 175/296 |
| 5,232,060 | * | 8/1993 | Evans | 175/297 |

* cited by examiner

*Primary Examiner*—Frank Tsay

(57) ABSTRACT

A downhole jar apparatus for use in oil and gas wells provides an improved construction that features a movable piston that imparts upward blows to the tool body during use. The apparatus includes an elongated tool body having upper and lower end portions and a longitudinal flow bore for enabling fluid to pass from the upper end of the tool body to the lower end portion thereof. A pair of pistons are slideably mounted within the tool body including an upper piston having a seat and a lower piston having a seat. A ball valving member is used to seal the upper piston, that ball valving member being pumped down through a work string such as a coiled tubing unit in order to reach the seat of the upper piston. A second valving member in the form of an elongated dart is disposed in between the two pistons. A trip mechanism separates the second valving member from the lower piston when a predetermined hydrostatic pressure value is overcome. Once the second valving member and lower piston are separated, the second piston is fired upwardly striking an anvil portion of the tool body to create the upward jar or blow.

16 Claims, 3 Drawing Sheets

DOWNHOLE JAR APPARATUS FOR USE IN OIL AND GAS WELLS

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil and gas well drilling, and more particularly to an improved downhole jar apparatus that delivers upward blows and which is activated by pumping a valving member or activator ball downhole through a tubing string or work string. Even more particularly, the present invention relates to an improved downhole jar apparatus for use in oil and gas wells that includes upper and lower pistons that are each movable between upper and lower positions, the lower piston having a valve seat and a valving member that can be moved to seal the valve seat wherein a trip mechanism separates the second valving member from the lower piston seat when a predetermined pressure value is overcome and a return mechanism returns the first piston to its upper position when the trip mechanism separates the second valving member from the lower piston seat to deliver an upward jar to the tool body.

2. General Background of the Invention

In downhole well operation, there is often a need for jarring or impact devices. For example, such a "jar" is often used in work over operations using a pipe string or work string such as a coil tubing unit or a snubbing equipment. It is sometimes necessary to provide downward jarring impact at the bottom of the work string to enable the string to pass obstructions or otherwise enter the well. During fishing operations or other operations, such as opening restriction (i.e., collapsed tubing) it is sometimes necessary to apply upward jarring or impact forces at the bottom of the string if the fishing tool or the like becomes stuck.

In prior U.S. Pat. No. 3,946,819, naming the applicant herein as patentee, there is disclosed a fluid operated well tool adapted to deliver downward jarring forces when the tool encounters obstructions. The tool of my prior U.S. Pat. No. 3,946,819, generally includes a housing with a tubular stem member telescopically received in the housing for relative reciprocal movement between a first terminal position and a second terminal position in response to fluid pressure in the housing. The lower portion of the housing is formed to define a downwardly facing hammer and the stem member includes an upwardly facing anvil which is positioned to be struck by the hammer. The tool includes a valve assembly that is responsive to predetermined movement of the stem member toward the second terminal position to relieve fluid pressure and permit the stem member to return to the first terminal position. When the valve assembly relieves fluid pressure, the hammer moves into abrupt striking contact with the anvil. The tool of prior U.S. Pat. No. 3,946,819, is effective in providing downward repetitive blows. The tool of the '819 patent will not produce upwardly directed blows.

In prior U.S. Pat. No. 4,462,471, naming the applicant herein as patentee, there is provided a bidirectional fluid operated jarring apparatus that produces jarring forces in either the upward or downward direction. The jarring apparatus was used to provide upward or downward impact forces as desired downhole without removing the tool from the well bore for modification. The device provides downward jarring forces when the tool is in compression, as when pipe weight is being applied downwardly on the tool, and produces strong upward forces when is in tension, as when the tool is being pulled upwardly.

In U.S. Pat. No. 4,462,471, there is disclosed a jarring or drilling mechanism that may be adapted to provide upward and downward blows. The mechanism of the '471 patent includes a housing having opposed axially spaced apart hammer surfaces slidingly mounted within the housing between the anvil surfaces. A spring is provided for urging the hammer upwardly.

In general, the mechanism of the '471 patent operates by fluid pressure acting on the valve and hammer to urge the valve and hammer axially downwardly until the downward movement of the valve is stopped, preferably by the full compression of the valve spring. When the downward movement of the valve stops, the seal between the valve and the hammer is broken and the valve moves axially upwardly. The direction jarring of the mechanism of the '471 patent is determined by the relationship between the fluid pressure and the strength of the spring that urges the hammer upwardly. Normally, the mechanism is adapted for upward jarring. When the valve opens, the hammer moves upwardly to strike the downwardly facing anvil surface of the housing.

BRIEF SUMMARY OF THE INVENTION

The downhole jar apparatus for use in oil and gas wells provides an improved construction that delivers upward blows only. The apparatus can be activated by pumping a valving member (e.g., ball) downhole via a coil tubing unit, work string, or the like.

The present invention thus provides an improved downhole jar apparatus for use in oil and gas wells that includes an elongated tool body that is supportable by an elongated work string such as a coil tubing unit. The tool body provides an upper end portion that attaches to the coil tubing unit with a commercially available sub for an example, and a lower end portion that carries a working member. Such a working member can include for example, a pulling tool to extract a fish, down hole retrievable controls, a gravel pack or a safety jar, a motor or directional steering tool.

The tool body has a longitudinal flow bore that enables fluid to flow through the tool body from the upper end to the lower end.

An upper piston (first piston) is slidably mounted within the tool body bore at the upper end portion thereof. The upper piston is movable between upper and lower positions and provides a valve seat.

A lower piston (second piston) is mounted in the tool body in sliding fashion below the upper piston and is also movable between upper and lower positions. The lower piston also provides a valve seat. A first valving member preferably in the form of a ball valving member is provided for sealing the valve seat of the upper piston.

The first valving member is preferably pumped downhole via the coil tubing unit or work string using fluid flow to carry it to the valve seat of the upper piston. A second valving member in the form of an elongated dart is disposed in between the upper and lower pistons. The second valving member has a lower valving end portion that can form a seat with the lower piston seat.

A trip mechanism is provided for separating the second valving member from the lower piston seat when a predetermined hydrostatic pressure value above the lower piston is overcome by compression of a spring portion of the trip mechanism.

A return mechanism returns the first piston to its upper position when the trip mechanism separates the second valving member from the lower piston seat.

The tool body has an anvil portion positioned above the lower piston for receiving blows from the lower piston when it rapidly returns to its upper position, once separated from the second valving member.

The tool body can include upper and lower tool body sections attached together end to end with a slip joint. This allows the force of upward blows delivered by the piston to exceed the tension applied from the surface through the tubing string.

A tappet can be provided above the first piston, the tappet and first upper piston being separately movable members with a beveled seat interface provided at the connection between the bottom of the upper piston and the top of the tappet.

The tappet is used to momentarily interrupt fluid flow when the second or dart valving member fires upwardly. This interruption of fluid flow contributes to the rapid upward movement of the lower piston so that it can impact the tool body providing an upward jar.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
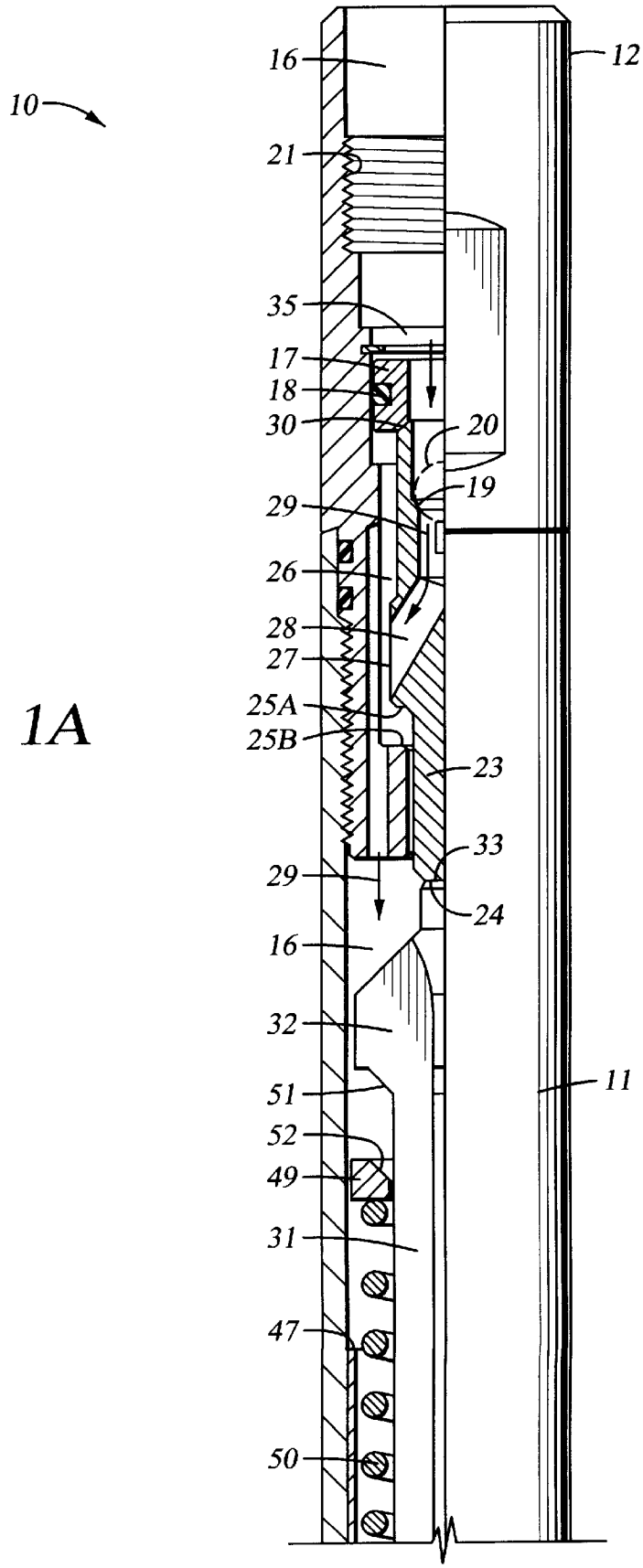
FIG. 1A is a sectional elevational view of the preferred embodiment of the apparatus of the present invention illustrating the upper portion thereof.
Figure 1B:
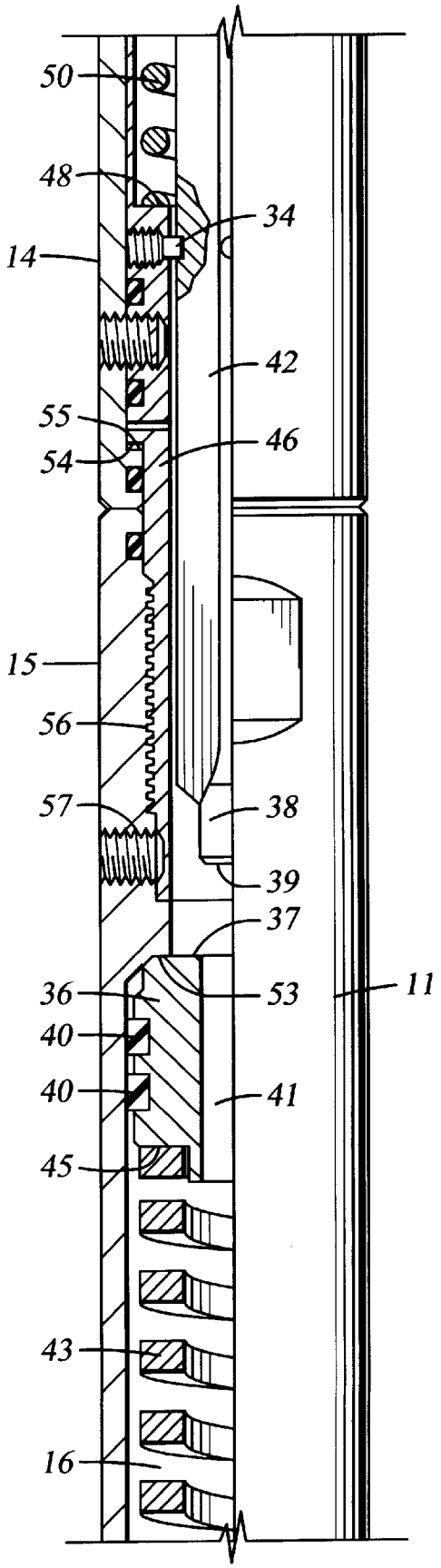
FIG. 1B is a sectional elevational view of the preferred embodiment of the apparatus of the present invention illustrating the central portion thereof.
Figure 1C:
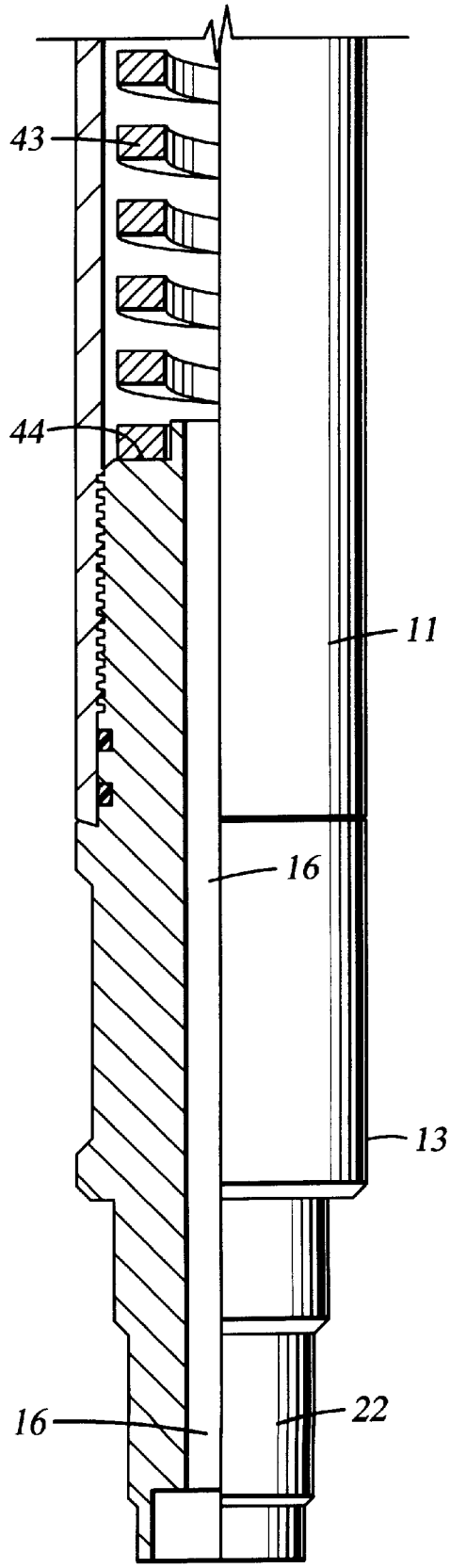
FIG. 1C is a sectional elevational view of the preferred embodiment of the apparatus of the present invention illustrating the lower end portion thereof.

FIGS. 1A, 1B, and 1C show generally the preferred embodiment of the apparatus of the present invention designated generally by the numeral 10. Jar apparatus 10 is comprised of an elongated tool body 11 having an upper end portion 12 and a lower end portion 13. The tool body 11 includes an upper tool body section 14 and a lower tool body section 15. The upper tool body section 14 is attached to the lower tool body section 15 through slip joint 46.

The tool body 11 has an elongated open ended flow bore 16 so that fluids can be pumped through the tool body 11 from the upper end 12 to the lower end 13.

At the upper end 12 of tool body 11, there is provided a first piston 17 having an O-ring 18 for forming a seal with tool body bore 16. Piston 17 sits upon tappet 23. The tappet 23 has a seat 19 that receives a ball valving member 20 that is dropped from the surface through a work string, coil tubing unit, or the like, so that the ball can be pumped down to the tool body 11 and into the bore 16 so that it registers upon the seat 19.

The upper end 12 of the tool body 11 provides internal threads 21 for forming a connection with a work string, coil tubing string, or the like. A commercially available connecting member or sub can be used to form an interface in between the tool body 11 and the coil tubing unit, work string, or the like. At its lower end portion, tappet 23 provides a generally flat surface 24 that receives a correspondingly shaped flat surface of dart valving member 31. Bore 16 enlarges below tappet 23 at 26. Annular shoulder 25A limits downward movement of piston 17 at shoulder 25B.

Flow channel 27 enables fluid to flow through the center of tappet 23 and around the tappet 23 as shown by arrows 29 in FIG. 1A. The center of the tappet 23 thus provides a tappet channel 28 through which fluid can flow when the seat 19 is not occupied by ball valving member 20. Annular seat 30 can include beveled surfaces on piston 17 and tappet 23 to form a sealing interface in between the bottom of upper piston 17 and the top of tappet 23.

Dart valving member 31 has an upper end portion 32 and a lower end portion 38. A flat surface 39 at lower end 38 can form a seal with seat 37 of second, lower piston 36.

To begin operation of the device, a shear pin or shear pins 34 (FIG. 1B) affix the position of dart valving member 31 in a fixed position relative to tool body 11. The ball valving member 20 is dropped from the surface via the flow bore of a coil tubing unit, work string, or the like. The ball valving member 20 is transmitted to the bore 16 using fluid flow. The ball valving member enters bore 16 at upper chamber 35 immediately above tappet 23 and piston 17. The ball valving member then registers upon seat 19 as shown by the phantom lines indicating the position of ball valving member 20 in FIG. 1A when it is forming a seal upon seat 19.

When the dart valving member 31 is pinned in place with shear pins 34, pumping fluid can pass through the tappet channel 28 and into flow channel 27 along the path indicated by arrows 29 in FIG. 1A. To activate the tool, the ball valving member 20 is pumped down from the surface via a coil tubing unit, work string or the like to the bore 16 and above piston 17 into upper chamber 35.

The ball valving member 20 seats upon seat 19 sealing the upper chamber and thus discontinuing the flow of fluid through the tool body 11. Hydrostatic pressure then builds up in upper chamber 35 above piston 17 due to the ball valving member 20 sealing upon seat 19. Upper piston 17 has 0-ring 18 that also contributes to the seal.

When pressure differential builds up sufficiently across piston 17, valve 31 is pressured down and the shear pin (or pins) 34 shear, allowing the dart valving member 31 with its flat valve surface 39 to move downwardly in tool body 11, and seal upon seat 37 of lower piston 36. Once this seal occurs at seat 37, pressure builds up in bore 16 of tool body 11 above seat 37 and above piston 36. Seals 40 are provided on piston 36.

The combination of the seals 40, the piston 36, and the seal of flat valving surface 39 upon seat 37 causes the lower piston 36 to move downwardly, gradually compressing and storing more and more energy in spring 43. At this time, the dart valving member 31 is held in position upon seat 37 by pressure differential above seat 37, thus pulling the dart valving member 31 downwardly, also storing energy in trip spring 50. The upper end 32 of dart valving member 31 provides a beveled annular surface 51 that corresponds in shape to the beveled annular surface 52 of trip washer 49.

When the dart valving member 31 and trip washer 49 move down as trip spring 50 is collapsed, the trip washer 49 encounters annual shoulder 47, breaking the seal at seat 37 between valving member 31 and piston 36. The trip spring 50 then causes the valving member to rapidly fly upwardly, its flat surface 33 striking the correspondingly shaped flat surface 24 of tappet 23. This action of valving member 31 striking tappet 23 creates a momentary seal at seat 30, interrupting incoming fluid flow. This flow interruption also allows the piston 36 to move upwardly in the tool body 11 very rapidly, striking an impact ledge or anvil in the form of an annular shoulder 53 (see FIG. 1B).

The tool upper body section 14 is attached to the lower tool body section 15 through slip joint 46. This allows the force of the upper blow delivered by piston 36 to exceed the tension applied from the surface through the coil tubing unit, work string or tubing string. The tension is transmitted from upper tool body section 14 to lower tool body section 15 through annular shoulders 54, 55. The slip joint can be attached to the lower tool body section 15 using threaded connection 56 and set screws 57.

The following table lists the parts numbers and parts descriptions as used herein and in the drawings attached hereto.

PARTS LIST

| Part Number | Description |
|---|---|
| 10 | apparatus |
| 11 | tool body |
| 12 | upper end |
| 13 | lower end |
| 14 | upper tool body section |
| 15 | lower tool body section |
| 16 | longitudinal flow bore |
| 17 | piston |
| 18 | O-ring |
| 19 | seat |
| 20 | ball valving member |
| 21 | internal threads |
| 22 | external threads |
| 23 | tappet |
| 24 | flat surface |
| 25A | annular shoulder |
| 25B | annular shoulder |
| 26 | bore |
| 27 | flow channel |
| 28 | tappet channel |
| 29 | arrow |
| 30 | seat |
| 31 | dart valving member |
| 32 | upper end |
| 33 | flat surface |
| 34 | shear pin |
| 35 | upper chamber |
| 36 | piston |
| 37 | seat |
| 38 | lower end |
| 39 | flat surface |
| 40 | seal |
| 41 | flow bore |
| 42 | rib |
| 43 | spring |
| 44 | annular shoulder |
| 45 | annular shoulder |
| 46 | slip joint |
| 47 | annular shoulder |
| 48 | annular shoulder |
| 49 | trip washer |
| 50 | trip spring |
| 51 | beveled annular surface |
| 52 | beveled annular surface |

-continued

PARTS LIST

| Part Number | Description |
|---|---|
| 53 | impact ledge |
| 54 | annular shoulder |
| 55 | annular shoulder |
| 56 | threaded connection |
| 57 | set screw |

The foregoing embodiments are presented by way of example only; the scope of the present invention is to be limited only by the following claims.

What is claimed is:

1. A downhole jar apparatus for use in oil and gas wells, comprising:

a) an elongated tool body having an upper end portion and a lower end portion, and a longitudinal flow bore that enables fluid to flow through the tool body from the upper end to the lower end;

b) an upper piston mounted at the upper end portion of the tool body, movable between upper and lower positions and having a valve seat;

c) a lower piston mounted below the upper piston, movable between upper and lower positions and having a valve seat;

d) a first valving member for sealing the valve seat of the upper piston so that hydrostatic pressure can build up above the upper piston;

e) a second valving member disposed in between the upper and lower piston and having a lower valving end portion that forms a seal with the lower piston valve seat, the second valving member being movable downwardly in the tool body bore responsive to a pressure increase above the upper piston;

f) a trip mechanism for separating the second valving member from the lower piston valve seat when a predetermined pressure value is overcome;

g) a return mechanism for returning the lower piston to its upper position when the trip mechanism separates the second valving member from the lower piston valve seat; and h) wherein the tool body has an anvil portion positioned above the lower piston for receiving force from the lower piston when it is returned to its upper position by the return mechanism.

2. The jar apparatus of claim 1 wherein the tool body includes upper and lower tool body sections attached together end to end with a slip joint.

3. The jar apparatus of claim 1 wherein the first valving member is a member that can be transmitted to the tool body via a work string.

4. The jar apparatus of claim 3 wherein the first valving member is a ball shaped valving member.

5. The jar apparatus of claim 1 further comprising a tappet that is positioned below the upper piston and above the second valving member.

6. The jar apparatus of claim 5 wherein the tappet and upper piston are separately movable members, and a seat interface is provided at the interface between the bottom of the upper piston and top of the tappet.

7. The jar apparatus of claim 1 wherein the second valving member has a generally flat upper end.

8. The jar apparatus of claim 1 wherein the second valving member has a generally flat lower end.

9. The jar apparatus of claim 1 wherein the trip mechanism includes a compressible member.

10. The jar apparatus of claim 9 wherein the compressible member is a spring.

11. The jar apparatus of claim 9 wherein the trip mechanism includes a compressible spring and a trip washer that cooperates with an annular shoulder on the tool body to separate the second valving member from the lower piston as the second valving member moves downwardly in the tool body.

12. The jar apparatus of claim 1 wherein the return mechanism includes a compressible member.

13. The jar apparatus of claim 12 wherein the compressible member is a spring.

14. The jar apparatus of claim 1 wherein the second valving member is preliminarily secured to the tool body with one or more shear pins that shear as hydrostatic fluid pressure is increased.

15. A downhole jar apparatus for use in oil and gas wells, comprising:

a) an elongated tool body supportable by a work string and having an upper end portion and a lower end portion, and a longitudinal flow bore that enables pressurized fluid to flow through the tool body from the upper end to the lower end;

b) an upper piston mounted at the upper end portion of the tool body, movable between upper and lower positions and having a valve seat;

c) a lower piston mounted below the upper piston, movable between upper and lower positions in the tool body and having a valve seat;

d) a first valving member for sealing the valve seat of the upper piston so that pressurized fluid can build hydrostatic pressure above the first valving member and upper piston;

e) wherein the upper piston is an assembly that includes an upper piston member and a tappet that carries the upper piston valve seat, the tappet and upper piston member being separable members that move downwardly together when the first valving member seals upon the valve seat of the upper piston assembly;

f) a second valving member disposed in between the upper and lower pistons and having a lower valving end portion that forms a seal with the lower piston valve seat;

g) a trip mechanism for separating the second valving member from the lower piston valve seat when a predetermined pressure value in the tool body flow bore above the upper piston and first valving member is overcome;

h) a return mechanism for returning the lower piston to its upper position when the trip mechanism separates the second valving member from the lower piston valve seat; and i) wherein the tool body has an anvil portion positioned above the lower piston for receiving force from the lower piston when it is returned to its upper position by the return mechanism.

16. A downhole jar apparatus for use in oil and gas wells, comprising:

a) an elongated tool body supportable by a work string and having an upper end portion and a lower end portion, and a longitudinal flow bore that enables pressurized fluid to flow through the tool body from the upper end to the lower end;

b) an upper piston mounted at the upper end portion of the tool body, movable between upper and lower positions and having a valve seat;

c) a lower piston mounted below the upper piston, movable between upper and lower positions in the tool body and having a valve seat;

d) a first valving member for sealing the valve seat of the upper piston so that pressurized fluid can build hydrostatic pressure above the first valving member and upper piston;

e) a second valving member disposed in between the upper and lower pistons and having a lower valving end portion that forms a seal with the lower piston valve seat;

f) a trip mechanism for separating the second valving member from the lower piston valve seat when a predetermined pressure value in the tool body flow bore above the upper piston and first valving member is overcome;

g) a return mechanism for returning the lower piston to its upper position when the trip mechanism separates the second valving member from the lower piston valve seat; and h) an anvil carried by the tool body for receiving blows from the lower piston when the lower piston travels upwardly in the tool body.

* * * * *